United States Patent [19]

Hood et al.

[11] Patent Number: 4,465,227

[45] Date of Patent: Aug. 14, 1984

[54] LEAK-PROOF CARTON

[75] Inventors: Paul F. Hood, Stamford, Conn.; Frank W. Locke, Minneapolis, Minn.

[73] Assignee: Champion International Corporation, Stamford, Conn.

[21] Appl. No.: 568,955

[22] Filed: Jan. 6, 1984

Related U.S. Application Data

[63] Continuation of Ser. No. 446,375, Dec. 2, 1982, abandoned.

[51] Int. Cl.[3] ..... B65D 5/22

[52] U.S. Cl. ..... 229/36; 229/39 R

[58] Field of Search ..... 229/33, 36, 35, 31, 229/39 R

[56] References Cited

U.S. PATENT DOCUMENTS

| | | | |
|---|---|---|---|
| 516,124 | 3/1894 | Sherman | 229/36 |
| 1,174,012 | 2/1916 | Bristol et al. | 229/36 |
| 1,707,680 | 4/1929 | Norwood | 229/36 |
| 1,837,602 | 12/1931 | Walter | 229/36 |
| 3,019,958 | 2/1962 | Asman et al. | 229/36 |
| 3,542,569 | 11/1970 | Farquitar | 229/31 R |
| 4,053,101 | 10/1977 | Hart, Jr. | 229/36 |
| 4,148,429 | 4/1979 | Burr et al. | 229/36 |
| 4,391,405 | 7/1983 | Drinon | 229/31 R |

FOREIGN PATENT DOCUMENTS

| | | | |
|---|---|---|---|
| 745493 | 11/1966 | Canada | 229/31 R |
| 869982 | 6/1961 | United Kingdom | 229/31 R |

*Primary Examiner*—Joseph Man-Fu Moy

*Attorney, Agent, or Firm*—Evelyn M. Sommer; William W. Jones

[57] ABSTRACT

A corrugated paperboard carton formed from a one-piece blank, which carton is leak-proof and can be assembled completely by machine. The carton is particularly adapted for containing a bulk supply of frozen eggs. The carton is erected, filled, and closed completely by machine.

8 Claims, 6 Drawing Figures

LEAK-PROOF CARTON

This application is a continuation of application Ser. No. 446,375, filed Dec. 2, 1982, now abandoned.

This invention relates to an improved carton which is adapted to be erected, filled and closed completely by machine. The carton is particularly suitable for containing frozen raw eggs which are packaged thusly in bulk amounts for shipment to large volume users, such as restaurants, hotels, hospitals, and the like.

Certain foods, such as eggs, are shipped to large volume users in bulk supply and frozen, ready for thawing and preparation. In the case of eggs, the eggs are removed from the shells, put into the containers in bulk amounts of thirty lbs. per container, and frozen while in the container. The containers in which such frozen bulk supplies of foods are packaged may be metal, or may be leak-proof corrugated paperboard. In each case, the containers must be filled and closed completely by machinery, and without being touched by human hands. In the case of the corrugated paperboard containers, the containers must also be erected completely by machinery and without being touched by human hands. In the case of packaging of the bulk amounts of eggs, the corrugated containers are erected and are moved along a conveyer to a filling station wherein the raw eggs are charged into the open containers. The filled containers are then moved further along the conveyor and are closed and then subjected to low temperatures sufficient to freeze the raw eggs in situ in the containers. In the event that any of the egg deposited in the container happens to splash onto the outside of the container after filling, then that container of eggs cannot be sold to consumers and must be discarded. Such splashing can occur as the container of eggs is transported on the conveyor prior to the freezing of the eggs in the container. From the above, it will be noted that a corrugated paperboard carton suitable for containing raw eggs in quantity should be leak-proof, should be erectable by machine without the need of human assistance, should be closable by machine after filling so as to negate the possibility of the egg material splashing onto the external surfaces of the carton, and should have a top structure which can be closed and sealed solely by machine so that the eggs can be frozen in situ within the carton.

The carton of this invention is formed from a one-piece cut and scored blank of corrugated paperboard material which is coated to render the paperboard leak-proof and to give the paperboard a ready release characteristic so that the frozen block of eggs can be easily removed from the carton for thawing and consumption. The carton has a bottom wall and side walls foldably connected to each edge of the bottom wall. The vertical edges of each side wall are connected together by bellows type corner panels which are folded back against and adhesively secured to the outer surfaces of the side walls. This ensures that the vertical corners of the carton are leak-proof. The top closure of the carton is provided by a series of top closure panels or flaps foldably connected to the top edges of the side walls. The top closure flaps include a pair of opposing major flaps which are substantially the same size as the bottom wall of the carton, and a pair of opposing minor flaps which are smaller than the bottom wall of the carton. One of the major closure flaps has a pair of stop tabs formed on its free edge opposite the fold line whereby it is connected to its associated side wall. A pair of tab engaging stop notches are formed at the fold line whereby the other major closure flap is connected to its associated side wall. The stop notches are contacted by the stop tabs when the first major closure flap is folded to a closed position so that the first major closure flap is prevented from entering the confines of the carton. Thus the open top of the carton is completely closed off by the first major closure flap when the latter is moved to its closed position. After the first major closure flap is moved to its closed position, the second major closure flap is folded to its closed position wherein it overlies the first major closure flap. The minor closure flaps are then folded down to their closed position overlying the second major closure flap. In this manner all of the top edges of the carton are closed by fold lines to which closure flaps are connected. The closure flaps are then sealed together in their overlying positions to seal the top of the carton, or are held in place by straps or the like.

It is, therefore an object of this invention to provide a corrugated paperboard carton suitable for packaging bulk supplies of frozen foods, such as eggs, or the like.

It is a further object of this invention to provide a carton of the character described which is formed from a one-piece blank of paperboard which is precut and scored and which can be erected, filled and closed solely by machinery.

It is an additonal object of this invention to provide a carton of the character described which is leak-proof and positively guards against spillage of the product onto the outside of the carton after the latter is filled and transported to the freezing station.

These and other objects and advantages of the invention will become more readily apparent from the following detailed description of a preferred embodiment thereof taken in conjunction with the accompanying drawings, in which.

Figure 1:
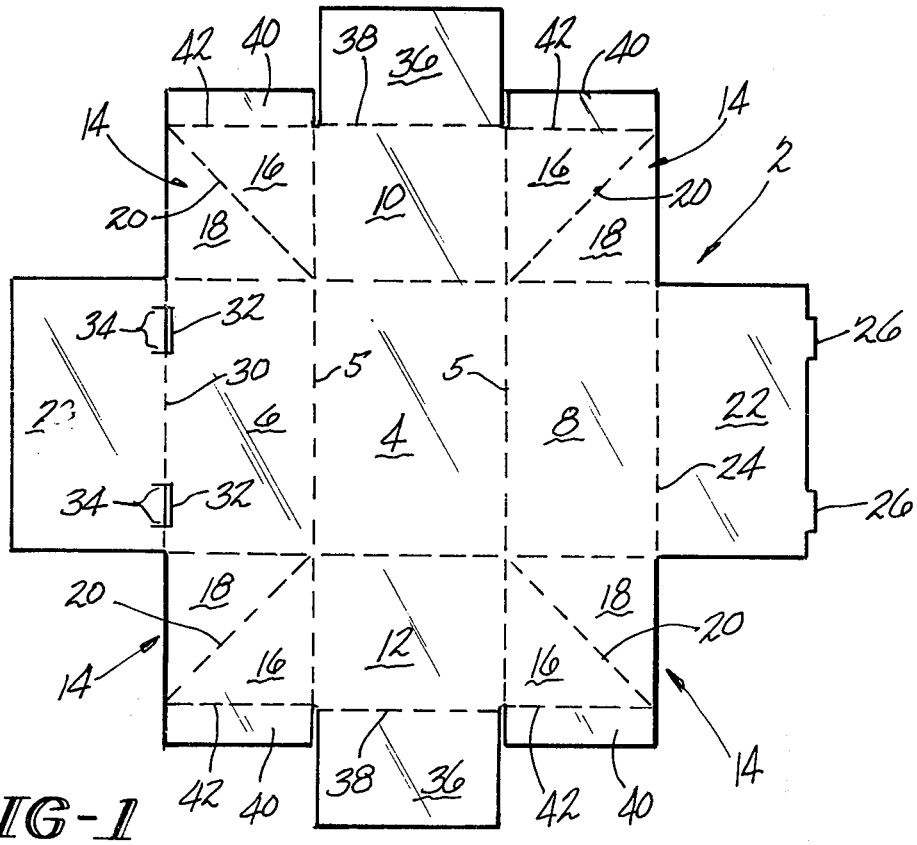
FIG. 1 is a plan view of a precut and scored blank of corrugated paperboard from which a preferred embodiment of a carton formed in accordance with this invention is made.

Referring now to the drawings, there is shown in FIG. 1 a preferred embodiment of a blank, denoted generally by the numeral 2, from which a preferred embodiment of the carton of this invention may be formed. The blank 2 includes a central bottom wall panel 4 to which are foldably connected side wall panels 6 and 8. End wall panels 10 and 12 are also foldably connected to opposite end edges of the bottom wall panel 4. Corner panels 14 are foldably connected to corner edges of the end wall panels 10, 12 and the corner edges of the side wall panels 6, 8 to interconnect corner edges of the end wall panel 10 with the side wall panels 6 and 8 and corner edges of the end wall panel 12 with the side wall panels 6 and 8. Each corner panel 14 is subdivided into adjacent triangular sub-panels 16 and 18 by a diagonal fold line 20. An inner major top closure panel 22 is foldably connected to the side wall panel 8 along a fold line 24. The free edge of the closure panel 22 opposite the fold line 24 is formed with a pair of projecting stop tabs 26. The stop tabs 26 are formed as rigid extensions of the panel 22 and are not connected thereto by fold lines. A major outer top closure panel 28 is connected to the side wall panel 6 by a fold line 30. Positioned on the fold line 30 are a pair of cuts 32, and adjacent to the cuts 32 on the panel 28 are zones 34 wherein the corrugated paperboard is crushed. A pair of minor top closure panels 36 are foldably connected to the top edges of the end wall panels 10 and 12 along fold lines 38. Extension panels 40 are foldably connected to the top edges of triangular panels 16 along fold lines 42. The entire blank 2 is coated on both sides with USDA approved wax or equivalent material. It should be noted that the top closure panel 22 is the same size as the bottom panel 4, and the distance between the free edges of the stop tabs 26 and the fold line 24 is greater than the distance between the fold lines 5 which define the side edges of the bottom panel 4.

Figure 2:
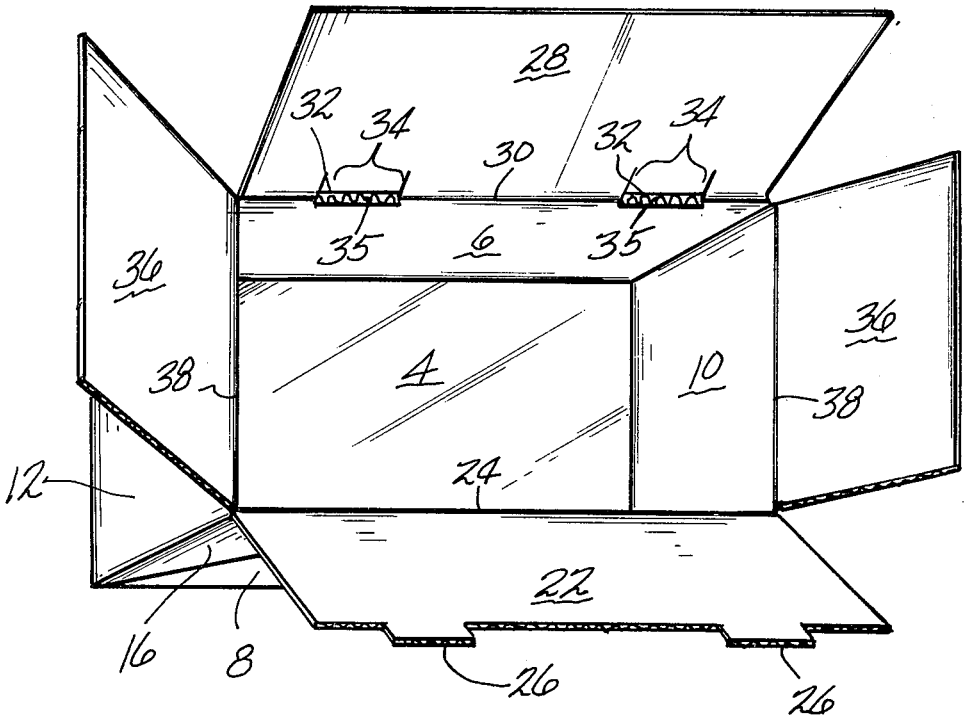
FIG. 2 is a top perspective view of the carton formed from the blank of FIG. 1, the carton being shown with its top open for receiving a product to be packaged in it.
Figure 3:
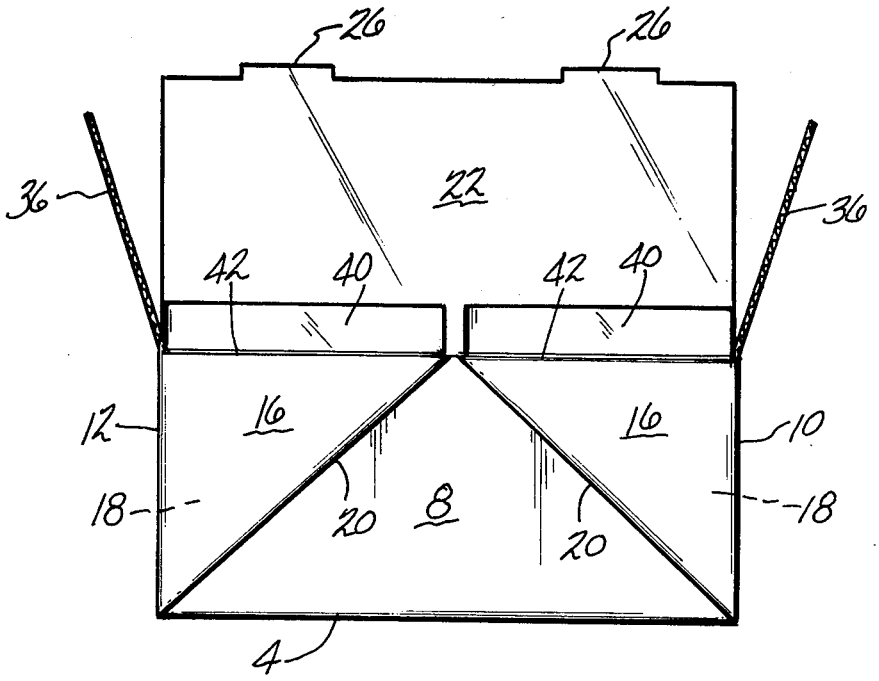
FIG. 3 is a side elevational view of the erected carton of FIG. 2 showing the top of the carton in its open configuration.

Referring now to FIGS. 2 and 3, the erected carton formed from the blank of FIG. 1 is shown. To erect the carton, the panels 6, 8, 10 and 12 are pivoted up to positions perpendicular to the bottom wall panel 4, and the corner panels 14 are internally folded about the fold lines 20, to form bellows-type corners on the carton. The triangular panels 16 and 18 are then brought into face-to-face relationship with each other and concurrently folded along their respective corner fold lines so as to bring the triangular panels 18 into face-to-face contact with the side wall panels 6 and 8. The panels 18 are glued or otherwise secured to the side wall panels 6 and 8 to hold the carton in its erected position. The extension panels 40 are glued to the major top closure panels 22 and 28. In order to form a less bulky carton, the triangular panels 16 and 18 may be crushed if so desired. The erected carton with its top open, as shown in FIG. 2, has its top closure panels 22, 28 and 36 then bent outwardly about fold lines 24, 30 and 38 respectively preparatory to filling with the product. When the top closure panel 28 is bent outwardly about the fold line 30, the cuts 32 and crushed regions 34 combine to create stop shoulders 35 which are located on the fold line 30. The stop shoulders 35 are aligned with the stop tabs 26 on the opposite top closure panel 22.

Figure 4:
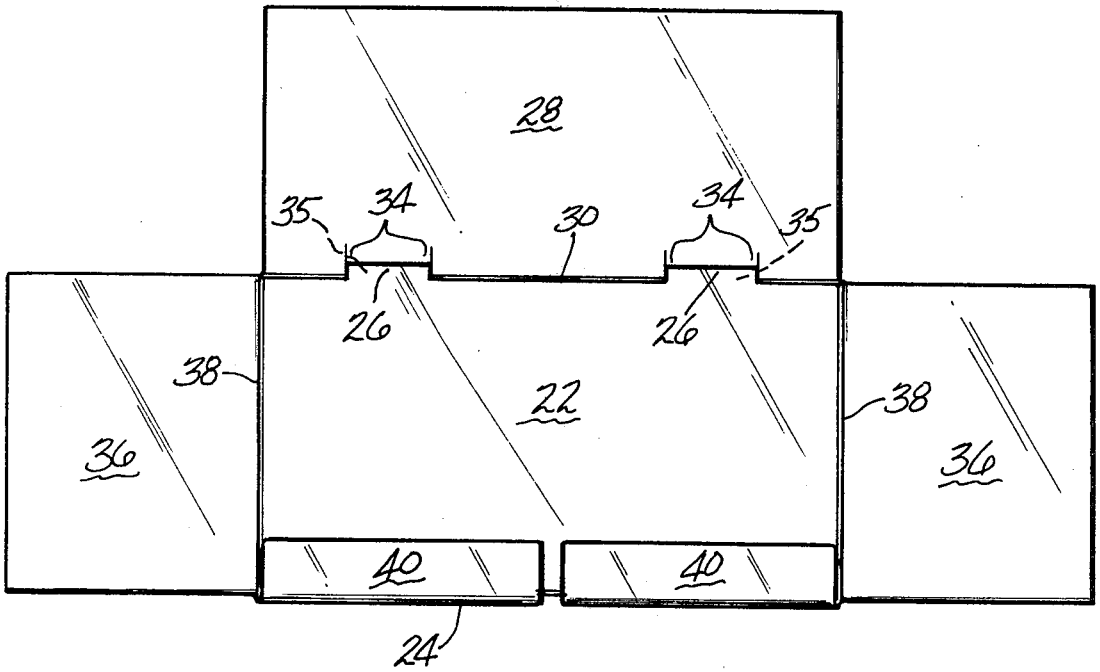
FIG. 4 is a top plan view of the carton of FIG. 2 showing the inner major top closure flap disposed in a carton-closing position.
Figure 5:
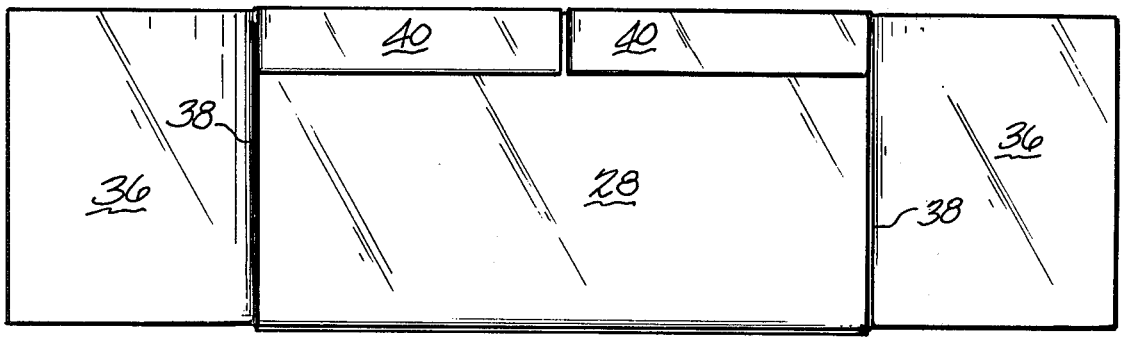
FIG. 5 is a top plan view of the carton of FIG. 4 showing the outer major top closure flap disposed in the carton-closing position overlying the inner major top closure flap.

As previously noted, the carton, as shown in FIGS. 2 and 3, is in the form which is transported by conveyor on the product filling and closing line. The carton passes through a filling station wherein the product to be packaged is dispensed from a bulk source thereof into the carton through the open top thereof. The filled carton then moves to a closing station downstream of the filling station wherein a sequence of top closing steps are performed. The first closure step, which is performed as soon after filling as possible, involves the pivoting of the inner major top closure panel 22 about the fold line 24 to a closed position shown in FIG. 4. In the closed position the panel 22 completely closes the open mouth of the carton. When the panel 22 reaches the closed position the stop tabs 26 engage the stop shoulders 35 so as to positively prevent the panel 22 from swinging into the confines of the carton into the product disposed in the carton. When the panel 22 is in the closed position, the product in the carton is prevented from sloshing onto the exterior surfaces of the carton by the panel 22. The next step in closing the carton involves pivoting the major outer top closure panel 28 about the hinge line 30 until the panel 28 overlies the panel 22, as shown in FIG. 5. The crushed zones 34 overlie the stop tabs 26 when the panel 28 is in the closed position shown in FIG. 5 whereby the stop tabs 26 will not interfere with the movement of the panel 28 to the overlying closed position shown in FIG. 5.

Figure 6:
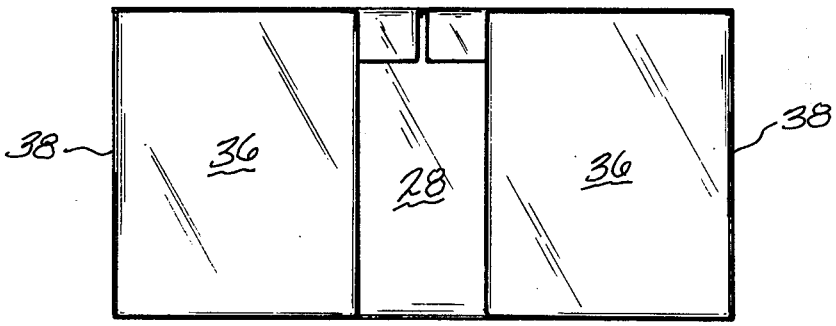
FIG. 6 is a top plan view of the carton of FIG. 5 showing the two minor top closure flaps disposed in the carton closing positions overlying the outer major top closure flap.

The final closing step involves swinging the minor top closure panels 36 about the fold lines 38 into overlying relationship with the panel 28, as shown in FIG. 6. The carton can be retained in its closed condition by adhering the respective panels 22, 28 and 36 in their overlying positions by adhesive, or by using carton-encircling straps to hold the top closure panels in place.

It will be appreciated that the subject carton is leak-proof and that the overlapping top closure panels provide a contamination resistant and leak-proof top closure. When the carton is used to hold a food product, the product can be frozen in situ in the closed carton after the closure has been completed. As noted above, the carton of this invention can be used to package food products, and also can be used to package other products which require leak-proof packaging. The carton of this invention can be shipped in bulk supply in the flat blank form and, when needed, can be erected, filled and closed solely by machinery without the need for human contact. This is particularly important when packaging bulk amounts of raw eggs which can foster rapid growth of bacteria.

Since many changes and variations of the disclosed embodiment of the invention may be made without departing from the inventive concept, it is not intended to limit the invention otherwise than as required by the appended claims.

What is claimed is:

1. A leak-proof carton formed from a one-piece blank of corrugated paperboard, said carton comprising:

(a) a bottom wall panel;

(b) side and end wall panels foldably connected to side and end edges of said bottom wall panel and extending perpendicular to said bottom wall panel;

(c) means forming leak-proof corners interconnecting corner edges of said side and end wall panels;

(d) an inner top closure panel connected to one of said end and side wall panels along a first fold line defining a top edge of said one of said end and side wall panels, said inner top closure panel being approximately the same size as said bottom wall panel and being pivotable between an open position and closed position;

(e) an outer top closure panel connected to the opposite one of said end and side wall panels along a second fold line defining a top edge of said opposite end and side wall panel, said outer top closure panel being pivotable between an open position and a closed position;

(f) means forming at least one stop shoulder on said second fold line;

(g) at least one stop tab formed on the edge of said inner top closure panel opposite said first fold line, said stop tab being rigidly connected to said inner top closure panel and being aligned with said stop shoulder and coplanar with said inner top closure panel when said inner top closure panel is pivoted to said closed position; and (h) top closure panels foldably connected to top edges of said end wall panels.

2. The carton of claim 1, wherein said means forming said stop shoulder comprises a slit in said second fold line and a zone in said outer top closure panel adjacent said slit wherein the corrugated paperboard is crushed.

3. The carton of claim 2, wherein there are a pair of stop shoulders formed on said second fold line and a pair of stop tabs formed on said inner top closure panel.

4. The carton of claim 1, wherein said means forming leak-proof corners comprises a pair of triangular panels at each corner foldably connected together along a diagonal fold line, with one of said triangular panels being foldably connected to a side wall panel and the other of said triangular panels being foldably connected to an end wall panel, with said one triangular panel being folded into face-to-face contact with the outer surface of said side wall and secured thereto, and with the other of said triangular panels being folded into face-to-face contact with said one triangular panel and secured thereto.

5. The carton of claim 4, wherein the corrugated paperboard in said triangular panels is crushed.

6. A leak-proof carton formed from a one-piece blank of corrugated paperboard, said carton comprising:

(a) a bottom wall panel;

(b) side and end wall panels foldably connected to side and end edges of said bottom wall panel and extending perpendicular to said bottom wall panel;

(c) an outer closure panel foldably connected to one of said side and end wall panels along a first fold line defining a top edge of said one panel;

(d) a pair of spaced apart slits formed in said first fold line to form a pair of stop shoulders thereon, there being zones of crushed corrugated paperboard formed on said outer closure panel adjacent said slits;

(e) an inner closure panel foldably connected to the opposite one of said side and end wall panels along a second fold line defining a top edge of said opposite panel, said inner closure panel being approximately the same size as said bottom wall panel, said inner closure panel having a pair of stop tabs formed on a free edge thereof opposite said second fold line, said stop tabs being aligned with said stop shoulders and rigidly projecting from said free edge and coplanar with said inner closure panel to engage said stop shoulders while remaining in the coplanar position when said inner closure panel is pivoted to a closed position;

(f) said outer closure panel being pivotable to a closed position overlying said inner closure panel; and (g) secondary closure panels foldably connected to the remainder of said side and end wall panels and pivotable to closed positions overlying said outer closure panel.

7. The carton of claim 6 further comprising compound corner panels foldably connected to corner edges of said side and end wall panels, said corner panels being divided into two triangular panels by a diagonal fold line with one of said triangular panels being folded into face-to-face contact with the outside surface of the side or end wall panel to which it is foldably connected and being secured thereto, and the other of said triangular panels being folded into face-to-face contact with said one of said triangular panels and secured thereto.

8. The carton of claim 7, wherein the corrugated paperboard forming said corner panels is crushed.

* * * * *